US011480901B2

(12) United States Patent
Chun et al.

(10) Patent No.: US 11,480,901 B2
(45) Date of Patent: Oct. 25, 2022

(54) FIXING DEVICE AND IMAGE FORMING DEVICE HAVE THE SAME

(71) Applicant: Hewlett-Packard Development Company, L.P., Spring, TX (US)

(72) Inventors: YongHo Chun, Suwon (KR); Sunhyung Lee, Suwon (KR); Jaehyeok Jang, Pangyo (KR); SeaChul Bae, Pangyo (KR); Jingue Ko, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,747

(22) PCT Filed: Oct. 25, 2019

(86) PCT No.: PCT/US2019/058113
§ 371 (c)(1),
(2) Date: Jun. 3, 2021

(87) PCT Pub. No.: WO2020/256762
PCT Pub. Date: Dec. 24, 2020

(65) Prior Publication Data

US 2022/0107594 A1 Apr. 7, 2022

(30) Foreign Application Priority Data

Jun. 17, 2018 (KR) ..... 10-2019-0071581

(51) Int. Cl.
*G03G 15/20* (2006.01)

(52) U.S. Cl.
CPC ..... *G03G 15/2053* (2013.01); *G03G 15/206* (2013.01); *G03G 15/2064* (2013.01); *G03G 2215/2058* (2013.01)

(58) Field of Classification Search
CPC ..... G03G 15/206; G03G 15/2017; G03G 15/2053; G03G 15/2064; G03G 2215/2003; G03G 2215/2058
See application file for complete search history.

(56) References Cited

U.S. PATENT DOCUMENTS

| | | | | |
|---|---|---|---|---|
| 10,303,082 | B2 | 5/2019 | Ozeki et al. | |
| 2013/0209149 | A1* | 8/2013 | Suzuki | G03G 15/2064 264/271.1 |

FOREIGN PATENT DOCUMENTS

| | | | |
|---|---|---|---|
| CN | 102486628 | A | 6/2012 |
| JP | H075783 | A | 1/1995 |
| JP | 1997152803 | | 6/1997 |
| JP | 2001100555 | | 4/2001 |
| JP | 2008026603 | A | 2/2008 |
| JP | 2008242177 | A | 10/2008 |
| JP | 2012189704 | | 10/2012 |
| JP | 2014098817 | A * | 5/2014 |
| JP | 2014119637 | | 6/2014 |
| JP | 2015055710 | | 3/2015 |

* cited by examiner

*Primary Examiner* — Thomas S Giampaolo, II
(74) *Attorney, Agent, or Firm* — Jefferson IP Law, LLP

(57) ABSTRACT

Provided is a fixing device to press a printing medium. The fixing device includes a rotating member and a pressure roller disposed to face the rotating member. The pressure roller includes a first groove and a second groove that extend along an outer circumferential surface respectively from a first end portion and a second end portion of the pressure roller. The first and second grooves are inclined with respect to a rotational axis of the pressure roller.

13 Claims, 5 Drawing Sheets

FIXING DEVICE AND IMAGE FORMING DEVICE HAVE THE SAME

BACKGROUND

An image forming device is a device to print an image on a printing medium, and includes a printer, a copier, a fax, and a multi-function peripheral (MFP) integrally incorporating these functions, or the like.

An electrophotographic image forming device forms a visible image by forming an electrostatic latent image on a surface of a photosensitive body by scanning light onto the photosensitive body charged to a predetermined potential, and then supplying a toner to the electrostatic latent image.

The visible image formed on the photosensitive body is directly transferred to the printing medium or transferred to the printing medium by passing through an intermediate transfer belt, and the visible image transferred to the printing medium is fixed to the printing medium, while passing through the fuser (or a fixing device).

BRIEF DESCRIPTION OF THE DRAWINGS

The above and/or other aspects of the disclosure will be more apparent by describing certain examples of the disclosure with reference to the accompanying drawings, in which.

DETAILED DESCRIPTION

When the specification states that one constituent element is "connected to" another constituent element, it includes a case in which the two constituent elements are connected to each other with another constituent element intervened therebetween as well as a case in which the two constituent elements are directly connected to each other. Further, when one constituent element "comprises (or includes)" another constituent element, unless specifically stated to the contrary, it refers to a condition in which other constituent elements may be further included rather than precluding the same.

An "image forming device" refers to a device to print printing data generated by a terminal device such as a computer on a printing medium. Examples of the image forming device include a copier, a printer, a fax, and a multi-function peripheral (MFP) integrally incorporating these functions through a single apparatus, or the like.

Examples described hereinafter are examples for easy understanding of the disclosure, and it should be understood that various changes can be made to examples described herein and the disclosure can be embodied in different forms.

In addition, in the following description, detailed descriptions of well-known functions or configurations will be omitted since they would unnecessarily obscure the subject matters of the disclosure. In addition, it should be noted that the drawings as attached are just for easy understanding of the disclosure, and are not illustrated as scaled, and dimensions of some elements may be exaggerated.

Figure 1:
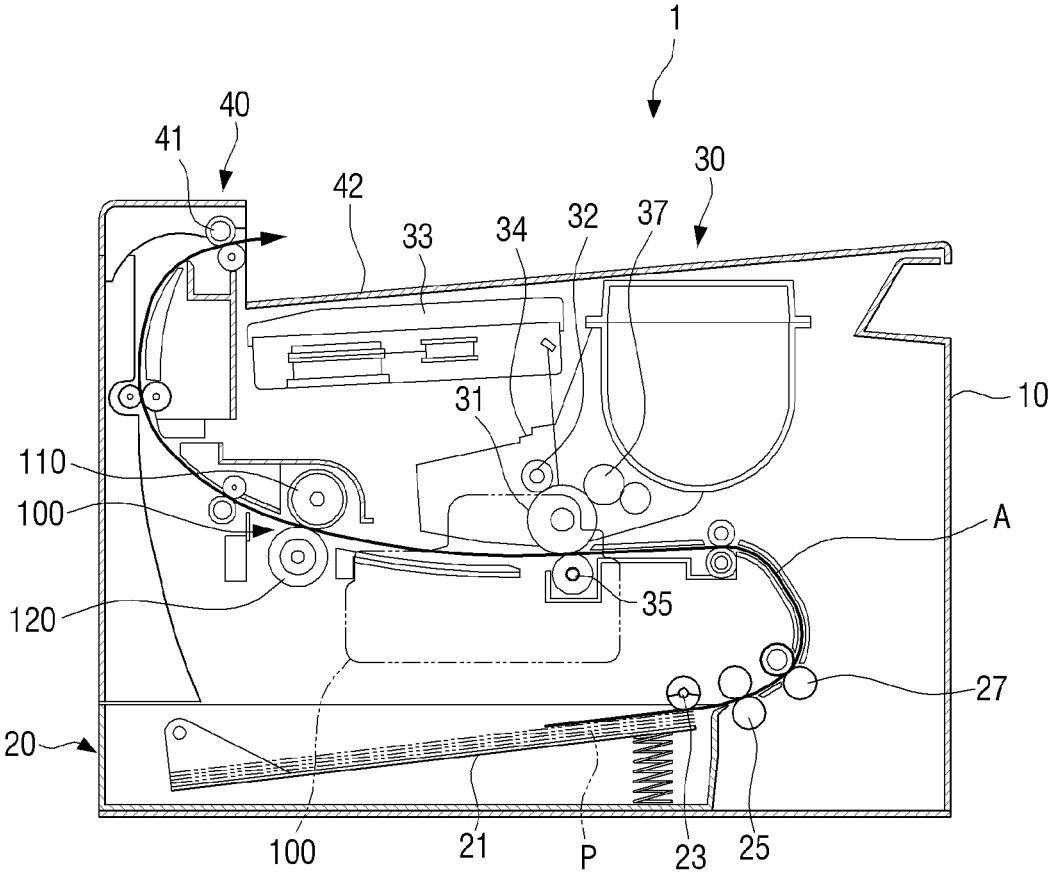
FIG. 1 is a cross-sectional view schematically illustrating an image forming device including a fuser according to an example.

Referring to FIG. 1, an image forming device 1 according to an example will be briefly described and a fuser 100 will be described in detail.

FIG. 1 is a cross-sectional view schematically illustrating the image forming device 100 including the fuser 100 according to an example.

An image forming device 1 may include a main body 10, a feeder 20, a printer engine 30, a fuser 100, and an eject apparatus 40.

The main body 10 may form an outer portion of the image forming device 1 and may support various components installed inside.

The feeder 20 may include a feeding tray 21 at a lower portion of the main body 10, a pick-up roller 23 for picking up the printing medium P piled on the feeding tray 21 one by one, a registration roller 25 which provides conveying force to the picked-up printing medium P and arranges the printing medium P evenly so that an image can be transferred on a desired portion of the printing medium P, and a feeding roller 27 which feeds the printing medium P between a photosensitive drum 31 and a transfer roller 35.

The printer engine 30 forms a predetermined image on the printing medium P provided by the feeder 20. The printer engine 30 may include the photosensitive drum 31, a charger 32, an exposure 33, a developer 34, and the transfer roller 35.

An electrostatic latent image is formed on the photosensitive drum 31. For example, an image may be formed on the photosensitive drum 31 by operations of the charger 32 and the exposure 33 which will be described later.

Hereinafter, for convenience of description, it has been described that the configuration of the printer engine 30 corresponds to one color by way of an example, but in actual implementation, the printer engine may include a plurality of photosensitive drums, a plurality of chargers, a plurality of exposures, a plurality of developers, an intermediate transferring belt, or the like.

The charger 32 may charge a surface of the photosensitive drum 31 to a uniform potential.

The exposure 33 may form an electrostatic latent image on a surface of the photosensitive drum 31 by changing the surface potential of the photosensitive drum 31 in accordance with information of an image to be printed.

The developer 34 accommodates a developing agent therein, and may supply the developing agent (for example, toner) to the electrostatic latent image and develop the electrostatic latent image into a visible image. The developer 34 may include a developing roller 37 which provides the developing agent to the electrostatic latent image.

The transfer roller 35 is installed to face an outer circumference of the photosensitive drum 31.

The fuser 100 applies heat and pressure while the printing medium P on which the image is transferred passes through the printer engine 30, to fix the image with developing agent on the printer medium P, and will be described below.

The eject apparatus 40 may include a eject roller 41 for ejecting the printing medium P which passes through the fuser 100 and is printed with a predetermined image thereon to an external discharging tray 42.

The configuration of an image forming device according to an example has been described in detail, but the developing method is not limited thereto, and the configuration of the image forming device according to the developing method may be varied and changed.

Hereinafter, the fuser 100 according to an example will be further described.

Figure 2:
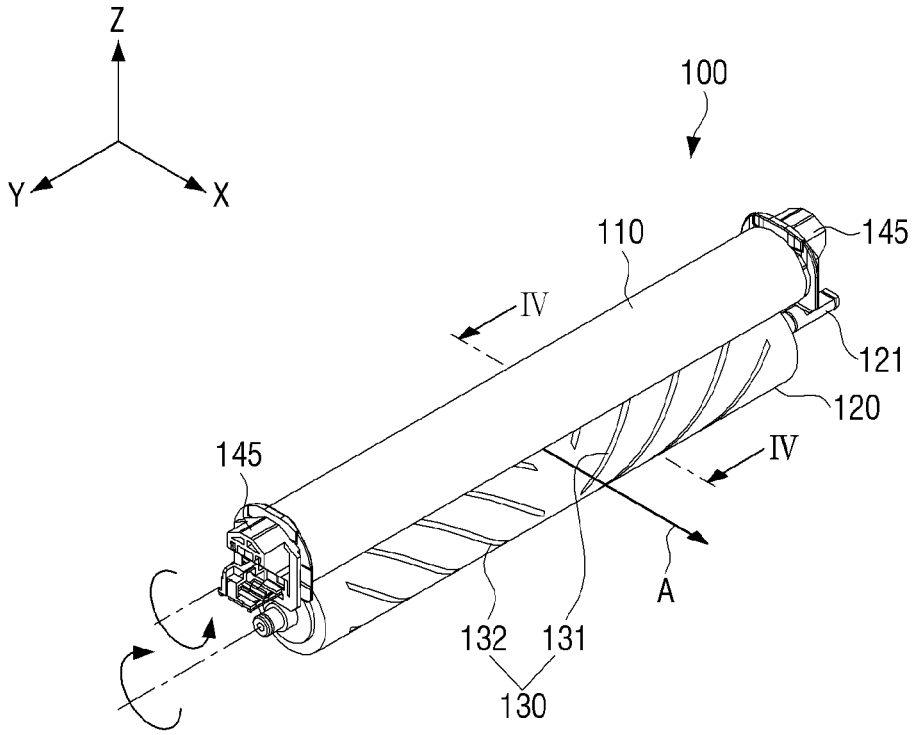
FIG. 2 is a perspective view illustrating a fuser according to an example.
Figure 3:
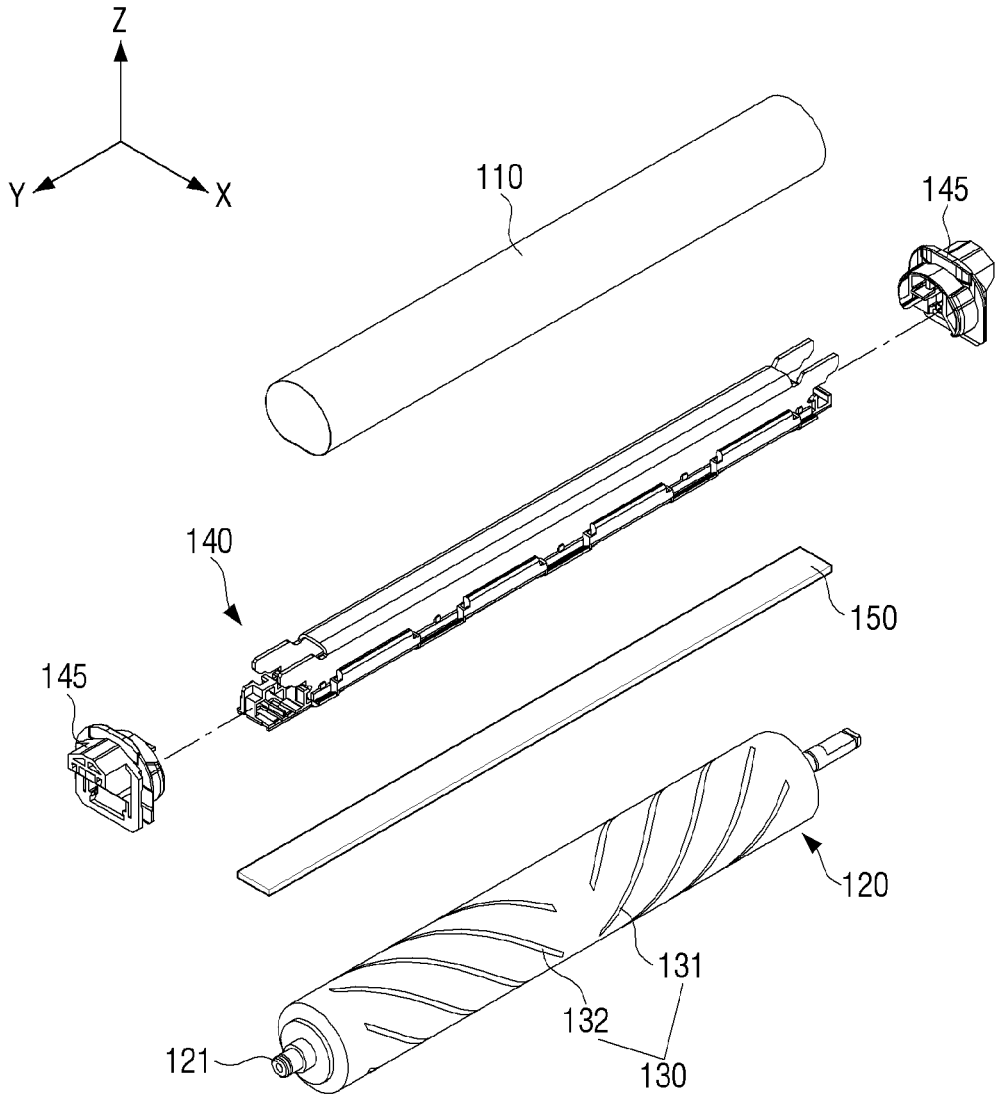
FIG. 3 is an exploded perspective view illustrating the fuser of FIG. 2.

FIG. 2 is a perspective view illustrating a fuser according to an example, and FIG. 3 is an exploded perspective view illustrating the fuser of FIG. 2.

Referring to FIGS. 2 and 3, the fuser 100 fixes the developing agent, which has been transferred, on the printing medium by applying heat and pressure to the printing medium P, and may include a rotating member 110, a pressure roller 120, and a pressing device (not shown).

The rotating member 110 may have a heat source 150 for providing heat to the printing medium on which the image is transferred in the developer 34. For example, the rotating member 110 applies a predetermined heat to the printing medium P, and it has been illustrated that the rotating member 110 according to an example is a belt type, but the rotating member 110 is not limited thereto, and may be formed as a roller type.

The rotating member 110 may be heated by the heat source 150 to be described later and may deliver heat to the printing medium P which passes between the rotating member 110 and the pressure roller 120.

The rotating member 110 is installed to face the pressure roller 120, and may form a fixing nip through which the printing medium P passes along with the pressure roller 120 applying pressure to the printing medium P.

The pressure roller 120 may rotate around by a rotational shaft 121. When the pressure roller 120 rotates, the rotating member 110 may rotate by frictional force between the rotating member 110 and the pressure roller 120.

The axial length of the rotating member 110 may be longer than the axial length of the pressure roller 120. The rotating member 110 may be composed of a single layer made of a metal, a heat resistant polymer, or the like, or may be formed by adding an elastic layer and a protective layer to a base layer formed of a metal or a heat resistant polymer.

The pressure roller 120 may be installed to face the rotating member 110 such that a constant fixing pressure is maintained between the rotating member 110 and the pressure roller 120. For example, the pressure roller 120 applies a predetermined pressure to the printing medium P and may be formed in a roller shape. The pressure roller 120 may be configured to rotate by receiving power from a drive source, such as a motor.

At an outer circumferential surface of the pressure roller 120, a groove 130 may be formed. The groove 130 formed on the outer circumferential surface of the pressure roller 120 may be formed symmetrically in a direction of a diagonal line with respect to the rotational shaft 121 towards an end of the pressure roller or toward both ends of the pressure roller in case of plural grooves.

For example, the groove 130 may include a first groove 131 which extends along the outer circumferential surface from a first end of the pressure roller 120 towards a second end of the pressure roller 120 and is inclined with respect to a rotational shaft 121 and a second groove 132 which extends along the outer circumferential surface from a second end of the pressure roller 120 towards the first end of the pressure roller 120 and is inclined with respect to the rotational shaft 121.

By the first groove 131 and the second groove 132 which are formed in an inclined state with respect to the rotational shaft 121, the pressure roller 120 may apply power to pull the printing medium P in a direction perpendicular to a moving direction of the printing medium P passing between the rotating member 110 and the pressure roller 120.

Therefore, creases and crinkles, which may occur due to heat, of the printing medium P passing through between the rotating member 110 and the pressure roller 120 may be prevented. A structure and shape of the groove 130 of the pressure roller 120 will be described later.

A supporting member 140 is installed inside the rotating member 110, and may support the inside of the rotating member 110 so that the rotating member 110 contacts the pressure roller 120 to form a fixing nip N.

The supporting member 140 may be formed to be longer than the length of the pressure roller 120. Therefore, when the pressure roller 120 contacts the rotating member 110 and forms the fixing nip N, bending of both ends of the rotating member 110 by the pressure roller 120 may be prevented.

The supporting member 140 may be formed to have a U-shaped cross section with a flat bottom. The supporting member 140 may be formed in a structure with a large area moment of inertia, such as an I-beam, H-beam, or the like shapes, in addition to the U-shape with a flat bottom.

A pair of flanges 145 may be installed at both ends of the rotating member 110, and may support inside of both ends of the rotating member 110, and restrict movement in a direction of the central axis of the rotating member 110.

Though not illustrated in FIG. 3, when the rotating member 110 rotates by the pressure roller 120, a pair of sliding members may be installed between the rotating member 110 and a pair of flanges 145, in order to minimize occurrence of fatigue crack at both ends of the rotating member 110.

The heat source 150 is a configuration to generate heat that is necessary for fixing an image, and may include a heat lamp (for example, a halogen lamp) or resistance heating. The heat source 150 may be disposed along a rotational shaft of the rotating member 110 inside the rotating member 110.

For example, the heat source 150 may be disposed on a bottom surface of the supporting member 140. In this case, a heat blocking member may be disposed between the supporting member 140 and the heat source 150 to prevent heat generated in the heat source 150 from being directly transferred to the supporting member 140. The heat source 150 may be configured as various heat sources, such as a halogen lamp, a hot wire, an induction heater, or the like.

A pressing device (not shown) may get the pressure roller 120 elastically biased so that the pressure roller 120 adheres to the rotating member 110.

Figure 4:
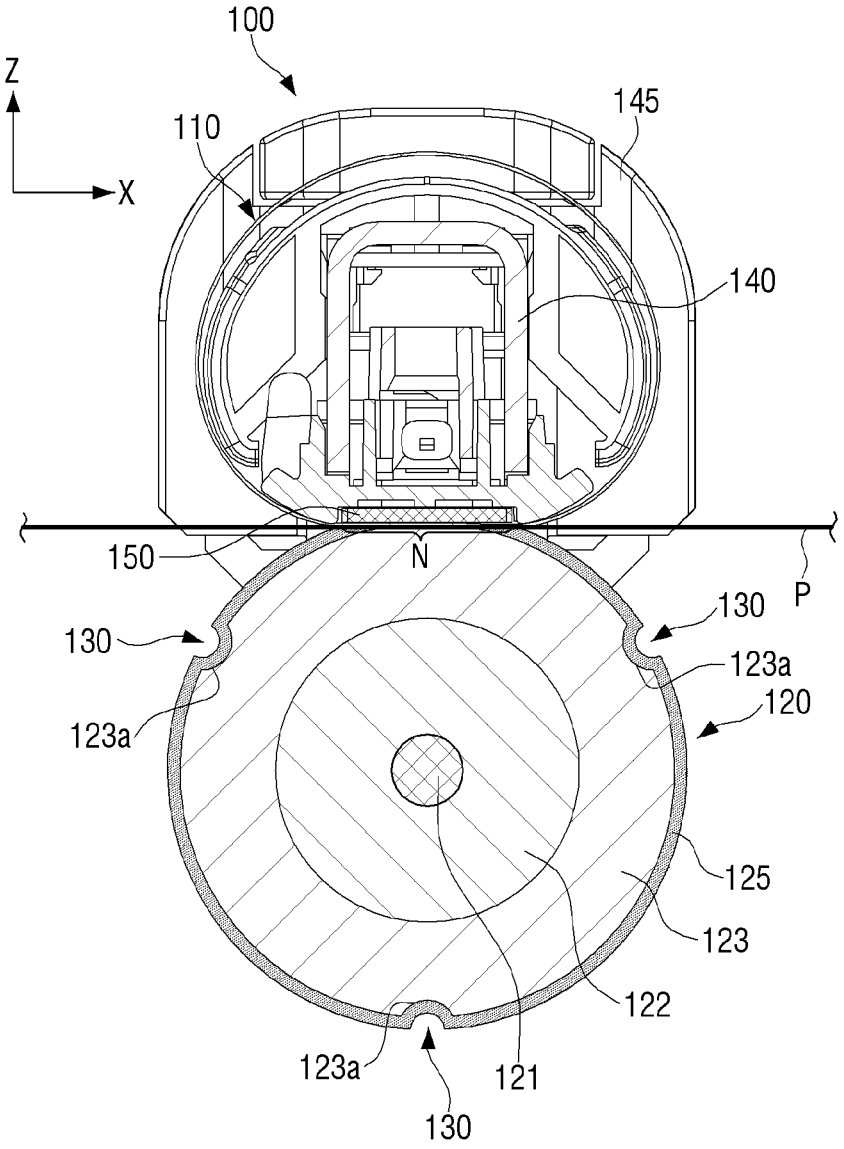
FIG. 4 is a cross-sectional view illustrating along IV-IV line of FIG. 2.

FIG. 4 is a cross-sectional view illustrating along IV-IV line of FIG. 2.

Referring to FIG. 4, the pressure roller 120 may apply pressing force toward the rotating member 110, and the fixing nip N may be formed between the pressure roller 120 and the rotating member 110 by the pressing force. For example, the fixing nip N may be formed at an upper side of the pressure roller 120 in contact with the rotating member 110.

Accordingly, when the pressure roller 120 rotates, the rotating member 110 may rotate by the frictional force with the pressure roller 120.

The pressure roller 120 may include the rotational shaft 121 formed of a conductive material such as aluminum or steel, and an elastic layer 123 which is installed to surround the rotational shaft 121 to elastically deform as the pressure roller 120 adheres to the rotating member 110, forms the fixing nip N between the pressure roller 120 and the rotating member 110, as the pressure roller 120 and the rotating member 110 are elastically deformed.

A core layer 122 may be disposed on an outside of the rotational shaft 121. The rotational shaft 121 may convey the rotational force of a driver (not shown) so that the elastic layer 123 may rotate. The core layer 122 is made of a metal material and may be formed in a cylindrical shape.

The rotational shaft 121 and the core layer 122 may be integrally formed, and for convenience of description, the rotation shaft 121 includes the core layer 122 integrally formed. The rotational shaft 121 may be formed such that the diameter of the center and the diameter of both ends are the same. That is, the rotational shaft 121 may be formed in a cylindrical shape having a constant diameter along the y-axis direction.

The pressure roller 120 which includes the rotational shaft 121 having a uniform diameter may minimize the pressure difference at the fixing nip N and prevent crinkling of the printing medium P which may occur in the fixing process by the rotational shaft 121 having the same diameter by the groove 130 formed along the outer circumferential surface of the pressure roller 120.

The elastic layer 123 may be formed of an elastic material such as polyurethane, silicon rubber, or the like, which surrounds the core layer 122.

The groove 130 formed on the outer circumferential surface of the pressure roller 120 may be formed by an inner groove 123*a* formed in the elastic layer 123. The inner groove 123*a* may be formed on the outer circumferential surface of the elastic layer 123. For example, the inner groove 123*a* may be formed to have a depth so that the inner groove 123*a* may be exposed to the surface of the pressure roller 120 by the release layer 125 surrounding the elastic layer 123 to be described later.

The groove 130 may be formed such that the cross section has a U-shape. The cross section of the groove 130 may be in a V-shape, a rectangular shape, in addition to the U-shape. For this purpose, the inner groove 123*a* may be formed such that the cross section has a U-shape. The cross section of the inner groove 123*a* may be formed in various shapes such as a V-shape, a rectangular shape, or the like, in addition to the U-shape.

The groove 130 may be formed to have a predetermined depth and a predetermined width. For example, the groove 130 may be formed to have a depth of 1 mm and a width of 1 mm. For this purpose, the inner groove 123*a* may be formed to have a predetermined depth and a predetermined width. For example, the inner groove 123*a* may be formed to have a depth greater than the depth of the groove 130, and have a width greater than the width of the groove 130.

The pressure roller 120 may include a release layer 125 provided to surround the elastic layer 123. The release layer 125 may prevent the printing medium which is in contact with the pressure roller 120 from attaching to the pressure roller 120. The release layer 125 which forms a surface of the pressure roller 120 may be formed of a conductive material such as a Perfluoroalkoxy (PFA) tube.

The release layer 125 may form an outermost layer of the pressure roller 120. The release layer 125 may surround the inner groove 123*a* formed in the elastic layer 123 so that the groove 130 is formed on a surface of the pressure roller 120.

The groove 130 that is formed symmetrically in a diagonal direction may be formed on the surface of the pressure roller 120. In FIG. 4, it has been described that the inner groove 123*a* is formed in the elastic layer 123, but it is not limited thereto and the inner groove 123*a* may be formed in the release layer 125.

For example, the groove 130 which is formed symmetrically in a diagonal direction may be formed on the surface of the pressure roller 120 through a manner of making the groove 130 shape inside the Perfluoroalkoxyalkane (PFA) tube forming the release 125 and putting the PFA tube on the elastic layer 123.

Figure 5:
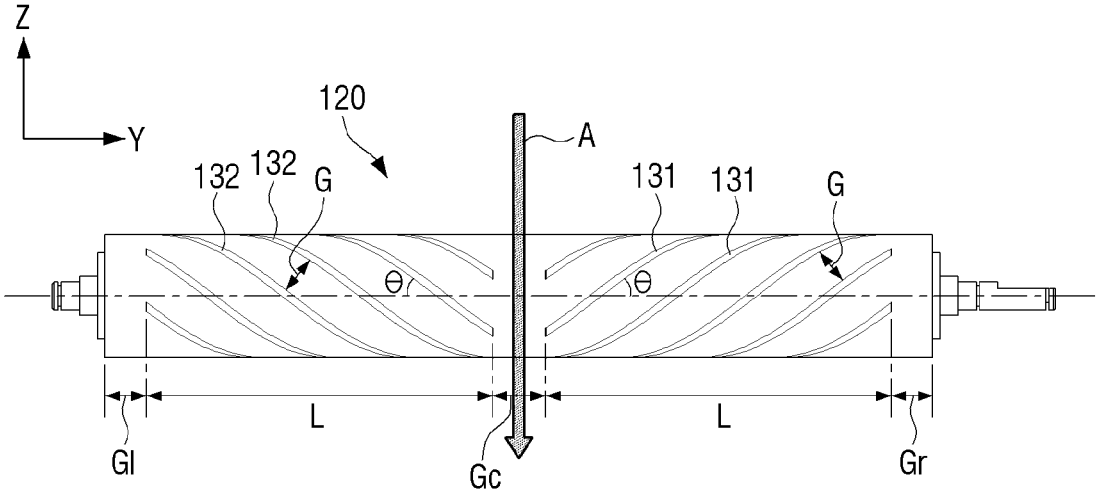
FIG. 5 is a front view of a pressure roller according to an example.

FIG. 5 is a front view of a pressure roller according to an example.

Referring to FIG. 5, the first groove 131 may extend along an outer circumferential surface from a first end of the pressure roller 120 and may be formed to be inclined with respect to the rotational shaft 121 of the pressure roller 120, and the second groove 132 may extend along an outer circumferential surface from a second end of the pressure roller 120 and may be formed to be inclined with respect to the rotational shaft 121 of the pressure roller 120.

The first groove 131 and the second groove 132 may be formed to be inclined toward a conveying direction (A) of the printing medium P. For example, the first groove 131 and the second groove 132 may be formed such that a portion in which a virtual extension line of the first groove 131 would be in contact with a virtual extension line of the second groove 132 facing the conveying direction (A) of the printing medium passing through the fixing nip.

The pressure roller 120 may rotate so that the portion in which the virtual extension line of the first groove 131 would be in contact with the virtual extension line of the second groove 132 would be in a direction to move forward.

The first groove 131 may be extensively formed in a diagonal direction towards the first end of the pressure roller 120, and the second groove 132 may be extensively formed in a diagonal direction towards the second end of the pressure roller 120 in a symmetrical manner with the first groove 131.

The first groove 131 and the second groove 132 may be symmetrically formed with respect to a virtual straight line crossing the rotational shaft 121. Here, the virtual straight line crossing the rotational shaft 121 is a straight line crossing the center of the lengthwise direction of the rotational shaft 121.

The first groove 131 may be formed to have an incline in the first direction toward the first end of the pressure roller 120 from the straight line crossing the center of the rotational axis of the rotational shaft 121. The second groove 132 may be formed to have an incline in the second direction toward the second end of the pressure roller 120 from the straight line crossing the center of the rotational axis of the rotational shaft 121.

Here, the first direction and the second direction are symmetrical to each other with respect to the virtual line crossing the center of the pressure roller 120. The first direction and the second direction are in a diagonal direction inclined with respect to a direction (Y-axis direction) of the rotational axis of the rotational shaft 121.

The first groove 131 and the second groove 132 may be formed to have a predetermined angle (θ). That is, the first groove 131 and the second groove 132 may be formed to be inclined with respect to the rotational axis direction (Y-axis direction), respectively. For example, the first groove 131 and the second groove 132 may be formed to have an angle (θ) of 30° to 45° with the rotational axis of the rotational shaft 121.

By the first groove 131 and the second groove 132 which are formed in a diagonal direction toward both ends of the pressure roller 120, force to pull the printing medium in a direction perpendicular to the conveying direction (A) of the printing medium P, when the printing medium P passes through the fixing nip, may be applied.

For example, the first groove 131 may apply pulling force to the outside of the first end portion in the right of the printing medium P passing through the fixing nip, and the second groove 132 may apply pulling force to the outside of the second end portion in the left of the printing medium P passing through the fixing nip.

That is, by the first groove 131 and the second groove 132, the pressure roller 120 may apply the force to pull the printing medium P in a direction perpendicular to the printing medium conveying direction (A) when the printing medium P passes through the fixing nip. Therefore, a phenomenon that crinkles occur in the printing medium P when the printing medium P passes the fixing nip may be prevented.

The first groove 131 may include a plurality of first grooves which are in parallel with each other, and the second groove 132 may include a plurality of second grooves which are in parallel with each other. For example, the first groove 131 may be formed of a plurality of first grooves that are in a line with the first direction, and the second groove 132 may be formed of second grooves that are in a line with the second direction. The plurality of first grooves 131 which are parallel with each other and the plurality of second grooves 132 which are parallel with each other may be formed to be symmetrical with respect to a virtual straight line crossing the rotational axis of the rotational shaft 121.

The plurality of first grooves may be disposed to be spaced apart from each other in a predetermined interval G. The interval G among the first grooves which are adjacent to each other, among the plurality of first grooves, may be between 10 mm and 20 mm.

Similarly, the plurality of second grooves may be disposed to be spaced apart from each other in a predetermined interval G. The interval G among the adjacent second grooves, among a plurality of second grooves, may be between 10 mm and 20 mm.

Intervals among a plurality of grooves may be formed in a uniform manner. However, the example is not limited thereto, and if the first groove 131 and the second groove 132 are symmetrical with respect to the virtual straight line crossing the center of the rotational shaft 121, the intervals among the plurality of grooves may not be uniform.

In FIG. 5, it has been described that the plurality of first grooves 131 which are parallel with each other and the plurality of second grooves 132 which are parallel with each other are symmetrically formed with respect to the virtual straight line crossing the rotational shaft 121, but the example is not limited thereto, and the plurality of first grooves 131 which are parallel with each other and the plurality of second grooves 132 which are parallel with each other may be disordered or asymmetrical with respect to the virtual straight line crossing the rotational shaft 121.

The first groove 131 and the second groove 132 may be spaced apart from each other by a predetermined distance Gc at the center of the pressure roller 120. The first groove 131 and the second groove 132 are formed not to be in contact with each other and thus, manufacturing the groove may be easy. The first groove 131 and the second groove 132 are to add pulling forces toward outside of both ends of the printing medium P passing through the fixing nip and it is sufficient that the groove 130 is formed at both ends of the pressure roller 120.

The first groove 131 may be spaced apart from the first end portion of the pressure roller 120 by a predetermined distance Gr, and the second groove 132 may be spaced apart from the second end portion of the pressure roller 120 by a predetermined distance GI. The first groove 131 and the second groove 132 are formed to be symmetrical, and the distance Gr between the first groove 131 and the first end portion of the pressure roller 120 and the distance G1 between the second groove 132 and the second end portion of the pressure roller 120 may be formed to be equal.

The distance Gc between the first groove 131 and the second groove 132 may be formed to be the same or shorter than the distance Gr between the first groove 131 and the first end portion of the pressure roller 120 and the distance GI between the second groove 132 and the second end portion of the pressure roller 120.

For example, the distance Gc between the first groove 131 and the second groove 132 may be 10 mm, the distance Gr between the first groove 131 and the first end portion of the pressure roller may be 11 mm, and the distance GI between the second groove 132 and the second end portion of the pressure roller may be 11 mm.

In this case, the first groove 131 and the second groove 132 may be formed to be the predetermined length in a direction of the rotational shaft 121 of the pressure roller, respectively. For example, the length L of the first groove 131 and the length L of the second groove 132 may be 100 mm, respectively.

The diameter of the rotational shaft 121 may be formed to be uniform entirely along a lengthwise direction (Y-axis direction) of the rotational shaft 121. As the pressure roller 120 may apply the force to pull the printing medium P in a direction perpendicular to the moving direction of the printing medium P when the printing medium P passes through the fixing nip, by the first groove 131 and the second groove 132 formed on an outer circumferential surface of the pressure roller 120, the rotational shaft 121 may minimize the difference between the diameter of the center and the diameter of both ends. For example, in the rotational shaft 121, the diameter of the center may be formed to be equal to the diameters of both ends.

As the diameter of the center is equal to the diameter of both ends, the rotational shaft 121 may provide the uniform pressure between the pressure roller 120 and the rotating member 110. Accordingly, output quality of the printing medium P which passes through between the pressure roller 120 and the rotating member 110 may be improved by the uniform pressure, and the life of the fuser 100 may be increased.

The pressure roller 120 according to an example includes the groove 130 which is symmetrically formed in a diagonal direction toward both ends of the pressure roller 120 and thus, crinkling in the printing medium P passing through the fixing nip N may be prevented.

The pressure roller 120 including the groove 130 may apply, to the printing medium P, the pulling force not only in the conveying direction A of the printing medium but also to the outside direction of both ends of the printing medium and thus may prevent crinkles from being generated. Accordingly, the pressure difference between the fixing nip N formed by the rotating member 110 and the pressure roller 120 may be resolved, and damage of the rotating member 110 due to meandering, fixedness by output positions of an image, and deviation of a degree of gloss may be improved.

The disclosure has been described by examples. The terminology used herein is for the purpose of description and should not be construed as limiting. Various modifications and variations are possible in accordance with the above teachings. Therefore, unless stated otherwise, the disclosure can be practiced freely within the scope of the claims.

What is claimed is:

1. A fixing device comprising:

a rotating member; and a pressure roller disposed to face the rotating member to form a fixing nip, the pressure roller including;

a plurality of first grooves parallel to each other which extend along an outer circumferential surface from a first end portion of the pressure roller, and a plurality of second grooves parallel to each other which extend along the outer circumferential surface of the pressure roller from a second end portion of the pressure roller, wherein the plurality of first grooves and the plurality of second grooves are inclined with respect to a rotational axis of the pressure roller, and wherein an interval between two first grooves, among the plurality of first grooves, adjacently disposed in parallel to each other, and/or between second grooves, among the plurality of second grooves, adjacently disposed in parallel to each other, is greater than or equal to 10 mm and less than or equal to 20 mm.

2. The fixing device of claim 1, wherein the plurality of first grooves and the plurality of second grooves are inclined toward a conveying direction of a printing medium.

3. The fixing device of claim 1, wherein the plurality of first grooves and the plurality of second grooves are symmetrical with respect to a virtual straight line crossing the rotational axis of the pressure roller.

4. The fixing device of claim 1, wherein the plurality of first grooves and the plurality of second grooves are symmetrical with respect to a center of the rotational axis of the pressure roller.

5. The fixing device of claim 4, wherein the plurality of first grooves and the plurality of second grooves are symmetrically or asymmetrically disposed with respect to a virtual straight line crossing the rotational axis of the pressure roller.

6. The fixing device of claim 1, wherein the plurality of first grooves and the plurality of second grooves are spaced apart from each other by a predetermined distance with respect to a virtual line crossing the rotational axis of the pressure roller.

7. The fixing device of claim 1, wherein, the plurality of first grooves extend from a location spaced apart from the first end portion of the pressure roller by a predetermined distance, and the plurality of second grooves extend from a location spaced apart from the second end portion of the pressure roller by a predetermined distance.

8. The fixing device of claim 1, wherein the plurality of first grooves or the plurality of second grooves are formed to be inclined with respect to the rotational axis of the pressure roller by greater than or equal to 30° and less than or equal to 45°.

9. The fixing device of claim 1, wherein each of the plurality of the first grooves or each of the plurality of the second grooves includes a cross section that is in a U-shape.

10. The fixing device of claim 1, wherein the pressure roller comprises:

a rotational shaft; and an elastic layer that is provided to surround the rotational shaft and forms the fixing nip with the rotating member, wherein the plurality of first grooves and/or the plurality of second grooves is formed on the elastic layer.

11. The fixing device of claim 10, comprising:

a release layer provided to surround the elastic layer.

12. The fixing device of claim 1, wherein a diameter of a center of the pressure roller is equal to a diameter of both ends.

13. An image forming device, comprising:

a photosensitive drum formed with an electrostatic latent image;

a developer to form a toner image on a printing medium by supplying toner to the electrostatic latent image; and a fuser to press the printing medium, wherein the fuser includes:

a rotating member; and a pressure roller disposed to face the rotating member to form a fixing nip, the pressure roller including;

a rotational shaft, an elastic layer surrounding the rotational shaft to form the fixing nip with the rotating member, a release layer surrounding the elastic layer, a first inner groove, formed in the elastic layer, which extends along an outer circumferential surface toward a first end portion of the pressure roller, and a second inner groove formed in the elastic layer, which extends along the outer circumferential surface of the pressure roller toward a second end portion of the pressure roller, a first groove, formed in the release layer, corresponding to the first inner groove, and a second groove, formed in the release layer, corresponding to the second inner groove, wherein the first inner groove and the second inner groove are inclined with respect to a rotational axis of the pressure roller.

* * * * *